United States Patent [19]

Kaulig et al.

[11] 3,959,847

[45] June 1, 1976

[54] FLOOR CLEANING APPARATUS

[75] Inventors: Heinz Kaulig, Wuppertal; Gerhard Orth, Solingen, both of Germany

[73] Assignee: Vorwerk & Co. Elektrowerke KG, Wuppertal, Germany

[22] Filed: Apr. 2, 1974

[21] Appl. No.: 457,231

[30] Foreign Application Priority Data

Apr. 12, 1973 Germany ..... 2318425

[52] U.S. Cl. ..... 15/368; 15/392

[51] Int. Cl.[2] ..... A47L 9/06

[58] Field of Search ..... 15/368, 372, 392, 41 R

[56] References Cited

UNITED STATES PATENTS

| | | | |
|---|---|---|---|
| 1,483,972 | 2/1924 | Hoover | 15/368 |
| 2,072,956 | 3/1937 | Martinet | 15/368 |
| 2,130,325 | 9/1938 | Pardee | 15/368 |
| 2,668,979 | 2/1954 | MacFarland | 15/368 |
| 3,744,077 | 7/1973 | Smyth | 15/41 R |

*Primary Examiner*—Peter Feldman
*Assistant Examiner*—C. K. Moore
*Attorney, Agent, or Firm*—Michael J. Striker

[57] ABSTRACT

A cylindrical brush, turnable about a horizontal axis in a housing, has hollow end portions extending along said axis. An arrangement for adjusting the brush relative to said housing and for removing it therefrom, is mounted in said hollow end portions of the brush. The adjusting arrangement comprises a pair of eccentrics respectively arranged in the hollow end portions of the brush, and having end portions normally arranged in openings in adjacent side walls of said housing.

14 Claims, 4 Drawing Figures

FLOOR CLEANING APPARATUS

BACKGROUND OF THE INVENTION:

The invention relates to a floor cleaning device of the vacuum cleaner type wherein a rotatable brush is used to dislodge dust and dirt on a floor covering, in a region wherein a partial vacuum is maintained by an air suction device to remove the dislodged dust and dirt. It has long been desired to construct such devices is as to clean a floor covering without leaving dusty and dirty margins and corners.

In earlier brush-type vacuum cleaners the housing structure for the brush was wider than the area effectively brushed. Therefore, dusty and dirty margins and corners unavoidably remained in the use of the earlier devices. In some types of such devices this was due to the provision of drive means, for example of a gear transmission and bearings, along side walls of the housing. In later models, the drive means, bearings and the like were located in the housing; but margins and corners of the floor coverings were still not cleaned effectively. This was particularly so since the side walls still had to provide any desired means for adjusting the brush relative to the housing and/or means to permit replacement of the brush when the bristles were worn. In some cases, the brush adjusting structures included support wheels for the housing and various linkages for raising or lowering the brush relative to the housing; those wheels and linkages were expensive as well as unwieldy. It also was difficult in earlier constructions to operate the brush adjusting and brush releasing devices as it was necessary to use special tools or to use very considerable force for these purposes.

SUMMARY OF THE INVENTION

The invention has the object of overcoming the former limitations and difficulties.

Another object is to provide apparatus for very complete cleaning of a floor, without leaving dusty and dirty margins and corners.

A further object is to provide a floor cleaning device which is simple to manipulate, and in which adjustment and replacement of the brush can be carried out in a simple manner.

Still another object is to minimize the danger of accidents, in the use, adjustment, and replacement of the brush. Still further objects will be noted hereinafter.

According to the invention the objects are achieved by the feature that substantially the entire mechanism for adjusting and releasing the brush is substantially disposed in hollow end portions of the brush itself. In order to brush even the floor areas below the side walls of the brush housing, the brush has bristles angularly mounted to extend laterally at least slightly beyond the side walls.

In a preferred embodiment of the invention, the cylindrical brush has a central bore terminally enlarged to provide hollow end portions, wherein the brush adjusting and brush replacing devices are mounted. These devices include a rigid rod, particularly an axle, which extends through the central bore in the brush body. The brush adjusting devices include eccentrics which are normally held in apertures of the side walls of the housing. Each eccentric comprises a hub extending into the adjacent hollow end of the brush body. The new arrangement provides not only for the desired adjustment of the brush and replacement thereof, but also provides for the further object of insuring quiet operation of the apparatus.

Advantageously one of the eccentrics has detent means to engage the adjacent side wall of the housing in any one of several detent notches peripherally spaced about a circular eccentric-receiving aperture in the side wall. It is preferred to rigidly connect this eccentric with the corresponding end of the aforementioned rigid rod. It is also preferred to provide in the outer end of this eccentric a slot for engagement by a suitable tool, such as a screw driver or a coin.

According to a further feature of the invention the opposite end of the rigid rod has the opposite eccentric held thereon slidable in axial directions, resilient means being provided to permit the aforementioned detent action and also for release of the brush as needed for its replacement. This other eccentric structure is held on its end of the rod against rotation relative to the same. The resilient means advantageously comprises a compression spring inserted in recesses formed in the corresponding eccentric and in the adjacent end of the rigid rod.

The side walls of the brush housing are substantially constructed in form of thin parallel vertical plates, with the rotary brush body extending from adjacent an inner surface of one to adjacent an inner surface of the other plate. End portions of the brush advantageously have bristles obliquely mounted thereon to apply brushing action also below side walls.

The new construction has a number of advantages. As it fully encloses all movable parts with the sole exception of the bristles of the brush, dangers of accident and injury are substantially eliminated. The floor surface or floor covering can be cleaned over the entire width of the device, including the marginal areas below the side walls of the housing. The operation can be kept smooth and quiet. At the same time, the life of the brush can be increased by successive adjustments; the brush action can be adjusted to various floor coverings; and when brush replacement is needed, it can be achieved rapidly and safely.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
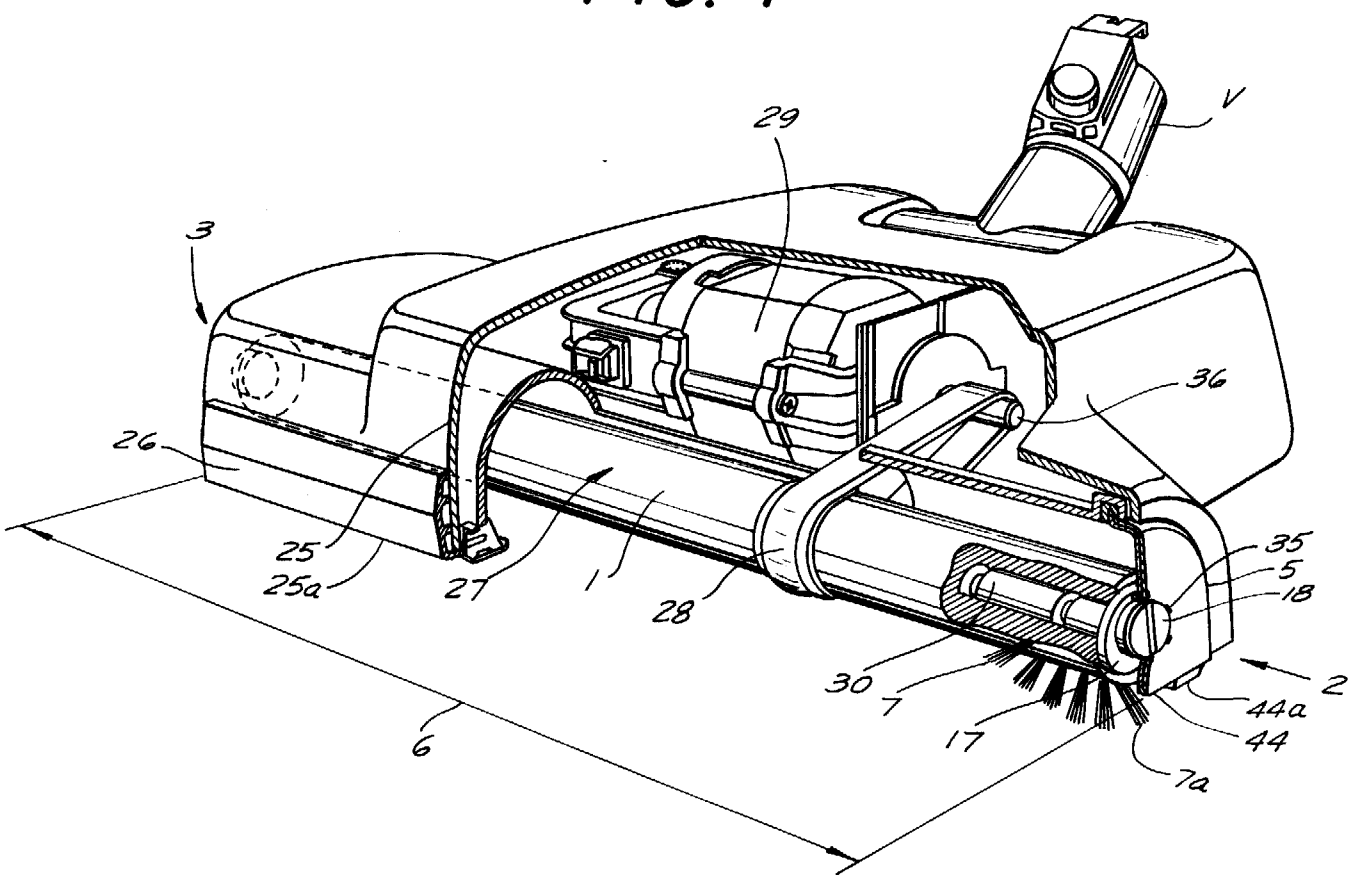
FIG. 1 is a perspective view of one embodiment of the invention, partly broken off in order to show internal structures.

As shown in FIG. 1, the invention comprises a brush unit which can be connected by a vacuum connector V to a suitable suction unit, not shown. Brush body 1 of a cylindrical brush 27 is horizontally disposed in a housing 25, parallel and adjacent to a vertical front wall 26 of this housing. Housing 25 also contains, behind the brush, a fractional horsepower motor 29 for driving the brush body 1 through a belt 28. As this brush body 1 rotates, bunches of bristles 7 suitably mounted on the outside of the brush body 1 dislodge the dust and dirt which is present on or in the floor covering to provide for removal of this dust and dirt through the vacuum connector V.

Figure 2:
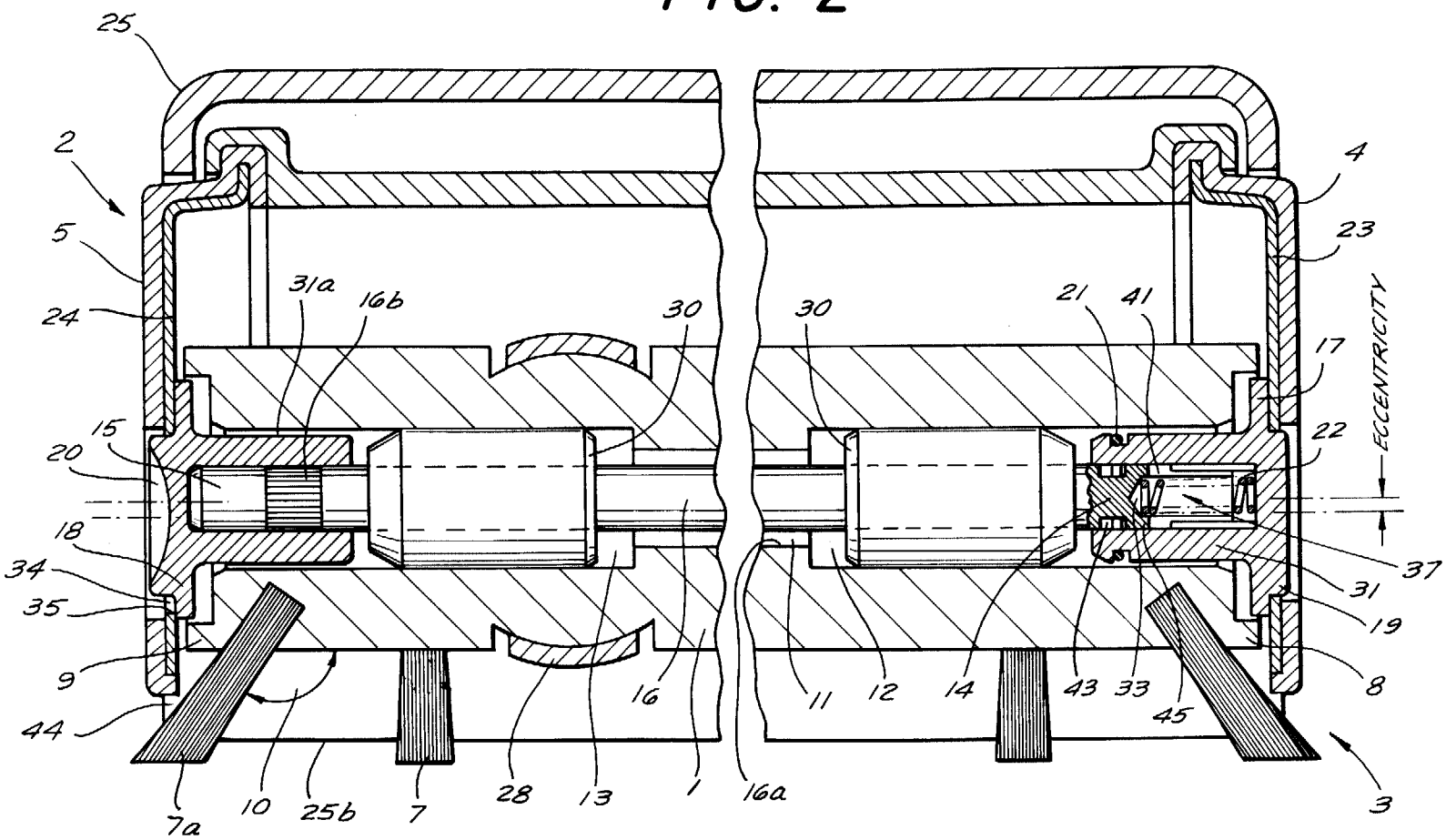
FIG. 2 is a vertical sectional view taken in a plane extending along the axis of the brush in FIG. 1 and looking at the structure from the back towards the front of FIG. 1.

According to the invention, the housing 25 has thin, vertical, parallel side walls 4 and 5, FIG. 2. It is shown as having in surface contact with inner surfaces of these side walls, equally thin mounting plates 23, 24. Brush body 1 is mounted in circular, coaxial apertures in the plates 23 and 24, by a brush adjustment device 2 and a brush release device 3. The latter devices 2, 3 are provided, respectively, at opposite ends of the brush body 1. They include, respectively, an eccentric 17 in the device 3 and an eccentric 18 in the device 2. A rigid rod 16 extends between the two eccentrics 17, 18. This rod is shown as also providing an axle for a pair of bearings 30 which provide for proper rotation of the brush body 1 about the rod 16. The rod extends through a central bore 16a in the brush body 1, which has two enlarged coaxial portions or recesses 12 and 13, one recess in each end portion of the brush body. These recesses 12, 13 contain the bearings 30. They also contain, closer to side walls 4 and 5, hub structures (31 at one end and 31a at the other end of the brush body 1) which are integral with eccentrics 17, 18, respectively. The eccentrics extend radially from respective ends of the hub structures 31, 31a for engagement with the apertures in the brush mounting plates 23, 24 of the side walls 4 and 5, respectively. Rotation of the eccentric 18 (at the left side of FIG. 2) is transmitted to the eccentric 17 (at the right side of FIG. 2), through the rod 16, by rigid connection of the hub structure 31*a* of the first-mentioned eccentric 18 to the corresponding end of the rod 16, for example by a press-fit 16*b*, and by suitable construction of the other eccentric and hub structure 17, 31 as will be described presently.

Figure 4:
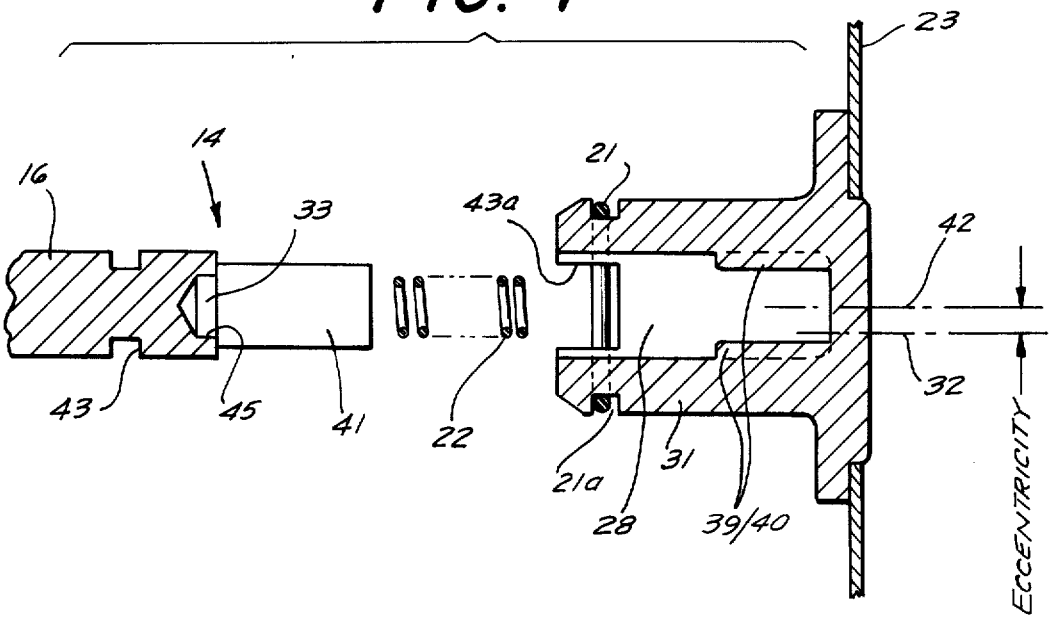
FIG. 4 is a detail from FIG. 2, showing right-hand portions thereof in exploded condition.

This other eccentric and hub structure 17, 31 is best shown in FIG. 4. It includes the cylindrical hub 31, the center of which defines the axis 42 for rotation of the brush unit. The axis of the eccentric 17 is shown at 32; it is parallel to the axis 42 of rotation but is eccentrically displaced relative to the same.

Figure 3:
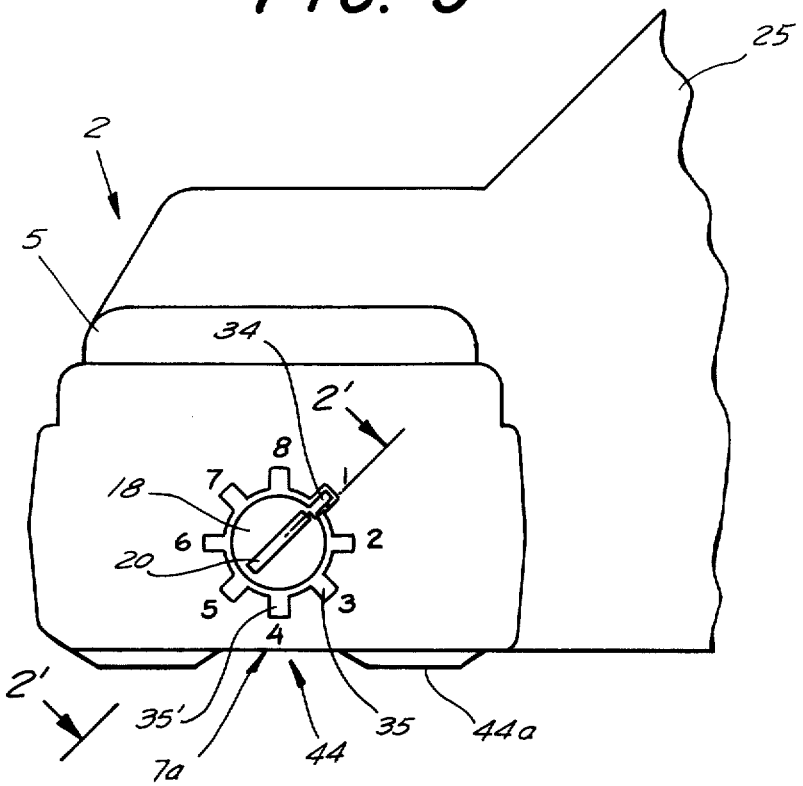
FIG. 3 is a partial side view of the apparatus, showing a left-hand portion of FIG. 2.

This displacement of the axis of rotation 42 serves to adjust the brush 27 relative to the housing 25 and is effected by turning the brush adjusting eccentric 18 from one position (shown at left in FIG. 2) into another position (shown at 2′—2′ in FIG. 3). For such turning of the eccentric 18 this eccentric and its hub 31*a* and the axle 16 are resiliently pressed a short distance into the housing 25, against a biasing force provided by a spring 22 in the hub 31 of the other eccentric 17.

Upon such pressing-in of The eccentric 18 a dog 34 thereon, previously detented in a slot 35 of the side wall plate 24 (FIG. 2) can be turned and newly detented in another similar slot (FIG. 3). The turning can be effected by inserting a tool, such as a screw driver or a coin, in a suitable slot 20 on the outside of the eccentric 18.

In the illustrated form of the invention this pressing-in and turning of the adjusting eccentric 18 can effect corresponding turning of the other eccentric 17, without removal of the latter from contact with its side wall plate 23, that is, by frictional sliding of a flange thereon along this side wall plate 23 (FIG. 2). Eccentric 17, including its portion 19 eccentrically displaced from axis 42 of rotation, remains engaged with the side wall plate 23, in the aperture of the latter, during such sliding.

As is best shown in FIG. 4, the central rod 16 has an end portion 14 diametrically slotted at 41, for engaging a pair of ribs 39, 40 which project radially inwardly from the hub 31. In order to avoid loss of the eccentric and hub structure 17, 31 from the shaft 16, on removal of the brush, a holding device is provided which is shown as including a spring clip 21 located on the outside of the hub 31 in a groove 21*a* surrounding this hub. A second peripheral groove 43 is formed on the end 14 of the rod 16 and is engaged by portions of the spring clip 21, which portions for this purpose extend inwardly to the inside of the hub 31, through at least one radial groove 43*a* in the inner end of the hub 31. The several parts, shown assembled in FIG. 2, include the aforementioned compression spring 22, which bears with one end against an axial recess 33 surrounded by an end wall 45 on the rod 16, at the inner end of the radial groove 41. The other end of the spring 22 bears against the inside surface of the eccentric and hub structure 17, 31. This construction allows axial sliding of the rod end portion 14 relative to ribs 39, 40, while firmly connecting the eccentric and hub structure 17, 31 for rotation with this portion 14.

In order to remove and replace the brush 27 from the housing 25 (FIG. 1) the belt 28 is removed from the output shaft 36 of the motor 29; the eccentric 17 is disengaged from its side wall plate 23 (FIG. 2) by manually pressing it slightly into the housing against the pressure of the spring 22; and the eccentric 18 is removed from detent engagement with its side wall plate 24 by opposite pressure, manually against the force of the spring 22. The required sliding of the rod 16 relative to the housing 25 and eccentric 17 is provided by suitable dimensioning of the several parts, including the hub 31 and the ribs 39, 40 and grooves 21a, 43a therein, as will be understood readily from the drawing.

Thus it is possible without special tools to remove the brush body 1 with its shaft 16, bearings 30 and eccentrics 17, 18 from the housing 25. Substantially all mechanisms used for this purpose, particularly the press-fit portion 16*b* of hub 31*a* and the several parts, described above, in the the other hub 31, are disposed in hollow end portions 12, 13 of the brush body 1, not in the side walls of the device thus making it possible to keep these side walls advantageously thin.

In order to allow cleaning of the floor, even below and beyond the thin side walls 4, 5, the end portions 8 and 9 of the brush body 1 have bunches of brushes 7a secured thereto in oblique orientation so that these bristles extend laterally below and at least slightly beyond these side walls. It will be understood that the other bristles 7 of the brush 1 extend, as usual, through a bottom aperture 44 in the housing 25 (FIG. 3). In the operation of the new floor cleaner, the front end portion of the housing 25 may rest on rigid side wall portions 44*a*, the lower edges of which can be suitably adjusted, relative to the outer edges of the bristles 7 and 7*a*, by the aforementioned height adjusting and brush releasing structures 2, 3.

It will be understood that each of the elements described above, or two or more together, may also find a useful application in other types of floor cleaners differing from the types described above.

While the invention has been illustrated and described as embodied in a floor cleaner, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. Floor cleaning apparatus of the vacuum cleaner type comprising a housing having a pair of side walls each provided with an aperture; a cylindrical brush in said housing extending between said side walls and turnable about a horizontal axis, said brush having a brush body provided with hollow end portions extending along said axis; and means for adjusting said brush body relative to said housing, said adjusting means having parts extending into said hollow end portions of said brush body, other parts mounted in said side walls of said housing and including eccentrics turnable in said apertures in said side walls, and means for arresting at least one of said eccentrics in a selected turned position, said arresting means including at least one detent projection on one of said one eccentric and the associated side wall, and a plurality of complementary detent recesses in the other of said associated side wall and said one eccentric for receiving said detent projection, and means in the other eccentric for resiliently biasing said one eccentric toward said associated side wall.

2. Floor cleaning apparatus of the vacuum cleaner type comprising a housing having a pair of side walls; a cylindrical brush in said housing and extending between said side walls turnable about a horizontal axis, said brush having a brush body provided with a central bore terminally enlarged to provide hollow end portions extending along said axis, two bearings for said brush body, one in each of said hollow end portions, and a rigid rod providing an axle for said bearings; and means for adjusting said brush body relative to said housing, said adjusting means having eccentric parts mounted in apertures in said side walls for turning therein about an eccentric axis, other parts extending into said hollow end portions, first mounting means for rigidly mounting one of said other parts on one end portion of said rod, and second mounting means for mounting the other of said other parts on the opposite end portion of said rod to cooperate in turning said rod about said eccentric axis, said second mounting means allowing displacement of said other of said other parts longitudinally of said rod for disengaging said eccentric parts from said apertures, said mounting means being disposed in said hollow end portions of said brush body, respectively.

3. Apparatus as defined in claim 2 wherein said second mounting means is a hub and said other eccentric extends radially, eccentrically from one end of said hub; the apparatus including a compression spring disposed in said hub and bearing against the same and against said other end portion of said rod.

4. Apparatus as defined in claim 3 including a first peripheral groove surrounding said hub; a radial groove in an axially inner end portion of said hub intersecting said peripheral groove; a second peripheral groove surrounding said other end portion of said rod; and spring clip disposed in said first peripheral groove to engage said second peripheral groove via said radial groove.

5. Apparatus as defined in claim 2 including an outwardly facing recess in at least one of said eccentrics for receiving a tool to rotate said one eccentric and thereby said rigid rod and said second mounting means thereon for the adjusting of the brush.

6. Apparatus as defined in claim 2 wherein said second mounting means includes a hub forming part of said other eccentric and projecting into the corresponding hollow end portion of the brush body; ribs projecting radially inwardly from said hub; and a diametric groove in said other end portion of said bar for engagement with said ribs.

7. A cleaning apparatus, comprising a housing having a pair of side walls laterally bounding an elongated recess in said housing having an open end, said side walls being provided with apertures which are aligned with one another in the longitudinal direction of said recess; a cleaning unit including a cleaning body having an axis of rotation, and means for supporting said cleaning body in said side walls and including a pair of eccentrics at axially spaced ends of said cleaning body, said eccentrics having an eccentric axis offset from said axis of rotation and being received in said apertures of said side walls, said eccentrics mounting said cleaning body in said apertures for rotation about said axis of rotation in parallelism with the elongation of said recess and being received in said apertures for selective turning therein about said eccentric axis to thereby adjust the distance of said axis of rotation from said open end, whereby the extent to which said cleaning body projects out of said open end of said recess and beyond said housing is adjusted; and means for arresting said eccentrics in a selected turned position and including detent means on at least one of said eccentrics, detent complementing means on the adjacent side wall, and means in the other eccentric for resiliently biasing said one eccentric toward the side wall adjacent thereto.

8. A cleaning apparatus comprising a housing having a pair of side walls laterally bounding an elongated recess in said housing having an open end, said side walls being provided with apertures which are aligned with one another in the longitudinal direction of said recess; and a cleaning unit including a cleaning body having an axis of rotation and a central bore terminally enlarged to provide hollow end portions, and means for supporting said cleaning body in said side walls and including a pair of eccentrics at axially spaced ends of said cleaning body, said eccentrics having an eccentric axis offset from said axis of rotation and being received in said apertures of said side walls, two bearings for said cleaning body, one in each of said hollow end portions, a rigid rod held by said eccentrics to provide an axle for said bearings, first mounting means for rigidly mounting one of said eccentrics on one end portion of said rod, and second mounting means for mounting the other eccentric on another end portion of said rod, opposite said one end portion to cooperate in turning said rod about said eccentric axis, said second mounting means allowing displacement of said other eccentric with respect to said rod axially thereof, both of said mounting means being disposed in said hollow end portions of said cleaning body, whereby said supporting mounts said cleaning body in said apertures for rotation about said axis of rotation in parallelism with the elongation of said recess and also for selective turning in said apertures about said eccentric axis to thereby adjust the distance of said axis of rotation from said open end and thus the extent to which said cleaning body projects out of said open end of said recess and beyond said housing.

9. A cleaning apparatus comprising a housing having a pair of side walls laterally bounding an elongated recess in said housing, said recess having an open end, said side walls being provided with apertures which are aligned with one another in the longitudinal direction of said recess; and a cleaning unit including a cleaning body having an axis of rotation, means for detachably supporting said cleaning body in said side walls for rotation about said axis of rotation and including a pair of eccentrics having end portions which have a common eccentric axis offset from said axis of rotation, said eccentrics being mounted at axially spaced ends of said cleaning body and at least one thereof being movable axially of said cleaning body between an extended and a retracted position, and means for urging said one eccentric towards said extended position, said cleaning unit being accommodated in said recess so that only said end portions of said eccentrics extend from said recess into said apertures of said housing when said one eccentric is in said extended position thereof and are received in said apertures with freedom of movement longitudinally of said recess against the action of said urging means, the movement of said one eccentric to said retracted position resulting in withdrawal of one of said end portions from the respective aperture into said recess whereby the entire cleaning unit can be removed from said recess of said housing.

10. Apparatus as defined in claim 9 wherein said body has a central bore terminally enlarged to provide hollow end portions; said supporting means including two bearings for said body, one in each of said hollow end portions, and a rigid rod held by said eccentrics to provide an axle for said bearings.

11. Apparatus as defined in claim 10, said supporting means including first mounting means for rigidly mounting the other eccentric on one end portion of said rod; and second mounting means for mounting said one eccentric on another end portion of said rod, opposite said one end portion, to cooperate in turning said rod with said eccentrics about said eccentric axis when said one eccentric is in said retracted position relative to said cleaning body; both of said mounting means being disposed in said hollow end portions of said cleaning body.

12. Apparatus as defined in claim 9, said body including bristles extending substantially radially of said body between said side walls, and bristles obliquely mounted on said body, adjacent said side walls, and extending laterally at least slightly beyond said side walls.

13. Apparatus as defined in claim 9, wherein said supporting means mounts said cleaning body in said apertures for selective turning therein about said eccentric axis when said one eccentric is in said retracted position relative to said cleaning body to thereby adjust the distance of said axis of rotation from said open end and thus the extent to which said cleaning body projects out of said open end of said recess and beyond said housing; and further including means for arresting at least a first one of said eccentrics in a selected turned position.

14. Apparatus as defined in claim 13 wherein said arresting means includes detent means on said first eccentric, and detent complementing means on the adjacent side wall.

* * * * *